US005766052A

United States Patent [19]

Metro et al.

[11] Patent Number: 5,766,052

[45] Date of Patent: Jun. 16, 1998

[54] COMBINATION CHILD FLOAT/ADULT AQUATIC EXERCISE DEVICE

[76] Inventors: Martin C. Metro; Naomi R. Fine, both of 8170 Hansom Dr., Oakland, Calif. 94605

[21] Appl. No.: 571,449

[22] Filed: Dec. 13, 1995

[51] Int. Cl.[6] ..... B63C 9/08

[52] U.S. Cl. ..... 441/130; 441/131; 441/38

[58] Field of Search ..... 441/35, 37, 38, 441/39, 65, 80, 81, 129, 130, 131, 132

[56] References Cited

U.S. PATENT DOCUMENTS

| | | | |
|---|---|---|---|
| 1,639,607 | 8/1927 | Henry . | |
| 2,051,281 | 8/1936 | Webber . | |
| 2,207,025 | 7/1940 | Rison . | |
| 2,724,843 | 11/1955 | Kimball . | |
| 2,946,068 | 7/1960 | Jasper . | |
| 3,074,084 | 1/1963 | Bisch . | |
| 3,147,498 | 9/1964 | Convis . | |
| 3,161,897 | 12/1964 | Hill . | |
| 3,860,976 | 1/1975 | Suyama . | |
| 4,729,331 | 3/1988 | Eggleston | 441/130 |
| 4,766,918 | 8/1988 | Odekirk | 441/38 |
| 4,799,910 | 1/1989 | Kellough . | |
| 5,358,438 | 10/1994 | Wolfe | 441/129 |

FOREIGN PATENT DOCUMENTS

| | | | |
|---|---|---|---|
| 418243 | 10/1934 | United Kingdom | 441/130 |

OTHER PUBLICATIONS

Swimways® Baby Tender 00153 advertisement.

*Primary Examiner*—Stephen Avila

[57] ABSTRACT

The floatation device is a combination of an adult water exerciser and a child float. The floatation device allows a child to float safely and securely on the water while an adult uses the device as a kickboard to push it or as a leg buoy to pull it. The floatation device includes a buoyant board and in the middle of the board is a generally circular opening through which an adult places a child onto a holding seat which hangs down directly underneath the opening. Attached to the rear of the board and directed over the opening is a canopy which is designed to shield the child from the sun and from splashes. The canopy includes a canopy window through which an adult pushing the board from behind may monitor the child. The floatation device also includes a handlebar attached to the rear of the board. An adult may grip the handlebar and use the floatation device like a kickboard. Alternatively, an adult can exercise using the backstroke while pulling the floatation device by using a leg grip which is attached to the underside of the board. An adult may use the floatation device by pressing the knees against the sides of the grip and leaning back to swim by using the backstroke.

16 Claims, 3 Drawing Sheets

COMBINATION CHILD FLOAT/ADULT AQUATIC EXERCISE DEVICE

TECHNICAL FIELD

The present invention relates generally to a child float for safely holding a child or infant in the water, and more particularly to a float in which the child or infant sits. Still more particularly, the invention relates to a unitary device which combines a child or baby float with an adult aquatic exerciser.

BACKGROUND ART

In general, adults and children enjoy playing and exercising in the water, but that activity can be dangerous due to the risk of drowning. The danger is even greater for young children and infants who need exceptionally close adult supervision. To reduce the risk and to lower the need for constant supervision, a child or baby float is commonly used as a safety device to keep a child's head above water.

Typically, a child float consists of a buoyant object which the child wears, or a float in which the child sits. In such a float, a child sits with its lower body below the surface of the water and with its upper body and head held above. But even when a child float is used, it is difficult to adequately supervise a child in the water when the adult is swimming.

For adults and adolescents, swimming is a popular form of exercise and recreation. Swimmers often use aquatic exercise and recreation devices to help focus their exercise on one area of their bodies. When swimmers wish to isolate their lower bodies, they often use a buoyant kickboard to provide a hydrodynamic object to keep their upper body afloat. A swimmer grasps the kickboard with the hands, faces the direction of travel, and kicks to move across the water. When swimmers want to isolate their upper bodies, they can use a floatable leg buoy sandwiched between their legs to provide a hydrodynamic object to keep their lower body afloat. Swimmers using leg buoys typically propel themselves backwards across the water using rowing-like strokes with the arms. Unfortunately, traditional leg buoys may be difficult to grip and are likely to slip away when swimmers attempt to adjust their legs.

DISCLOSURE OF THE INVENTION

The present invention overcomes the drawbacks of existing child floats and aquatic exercisers. A principal object of the present invention is to provide an aquatic floatation device which is a combination baby float and aquatic exerciser. The device safely supports and carries a child on the water, and a supervising adult may grasp the device and use it as an aquatic exerciser.

The invention includes a board constructed from a buoyant foam material, and is provided with a generally circular opening located in the middle of the board. An adult places a child onto a holding seat which hangs beneath the opening. Thus, the child sits on and straddles the holding seat with only its lower body submerged. The child may be placed facing either forwardly or rearwardly, and can play with toys mounted on toy racks mounted on the front and rear of the board. Attached to the rear of the board and extending over the opening is a canopy designed to shield the child from the sun and splashes. Preferably, the canopy is made of a sturdy fabric such as nylon, and may be removable. The canopy includes a window through which an adult pushing the board from behind may monitor the child.

The device also includes a sturdy wrap-around handlebar attached to the rear of the board. An adult may grip the handlebar and use the device as a traditional kickboard. The device provides a stable hydrodynamic object to keep the upper body afloat, thereby allowing the adult to isolate the lower body during swimming exercise. While swimming and pushing the device, an adult can see and interact with the child through the canopy window.

Instead of pushing the device, an adult can pull it across the water using a generally tear-drop shaped leg grip which extends downwardly from the underside of the board. The adult may use the leg grip by clinching the legs around the sides of the grip and leaning back to then swim using the backstroke or sidestroke. In this manner, the adult may swim while still able to watch the child seated in the device.

These and other objects and advantages of the present invention will be more readily understood after a consideration of the drawings and the detailed description of the preferred embodiment which follows.

DETAILED DESCRIPTION OF THE PREFERRED EMBODIMENT AND BEST MODE FOR CARRYING OUT THE INVENTION

Figure 3:
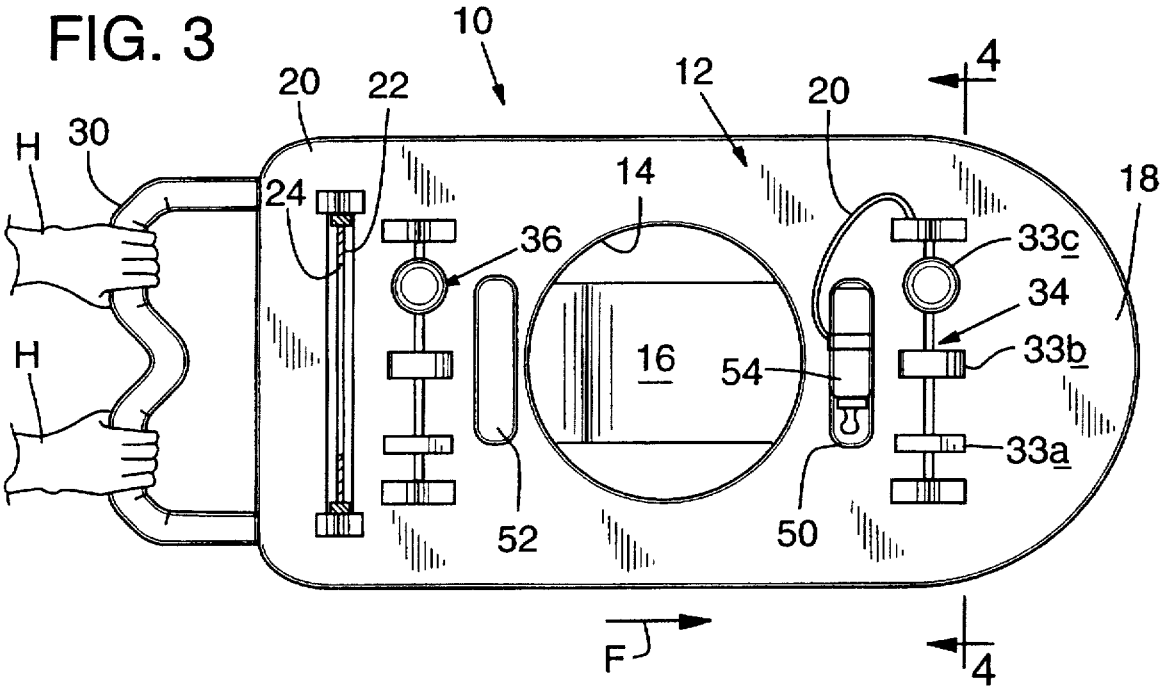
FIG. 3 is a top plan view of the floatation device of FIG. 1.
Figure 4:
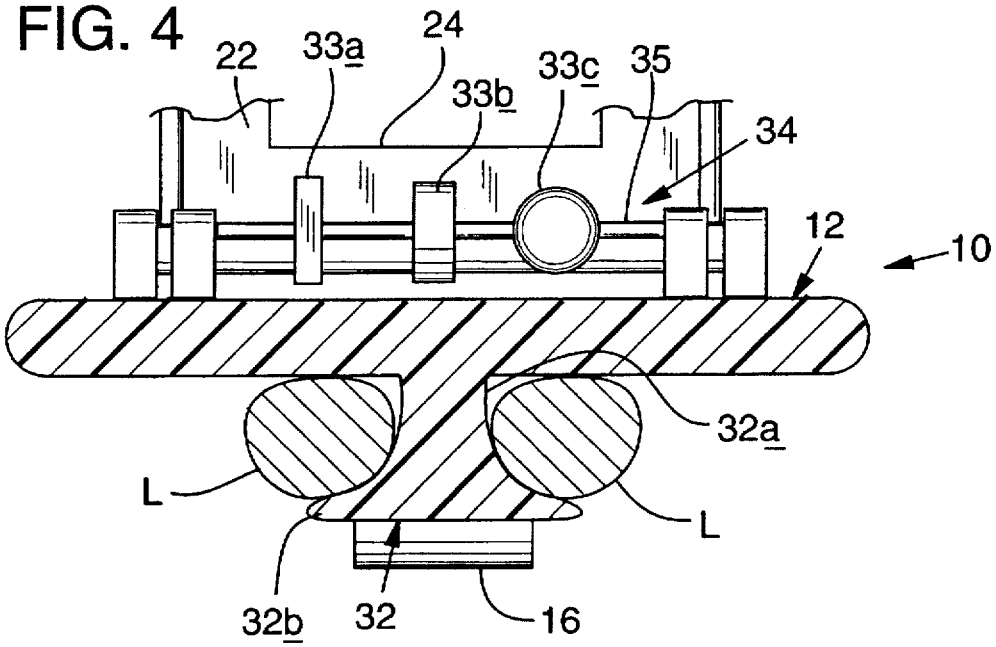
FIG. 4 is a front elevation cross-sectional view of the floatation device of FIG. 1 and taken along line 4—4 of FIG. 3.
Figure 5:
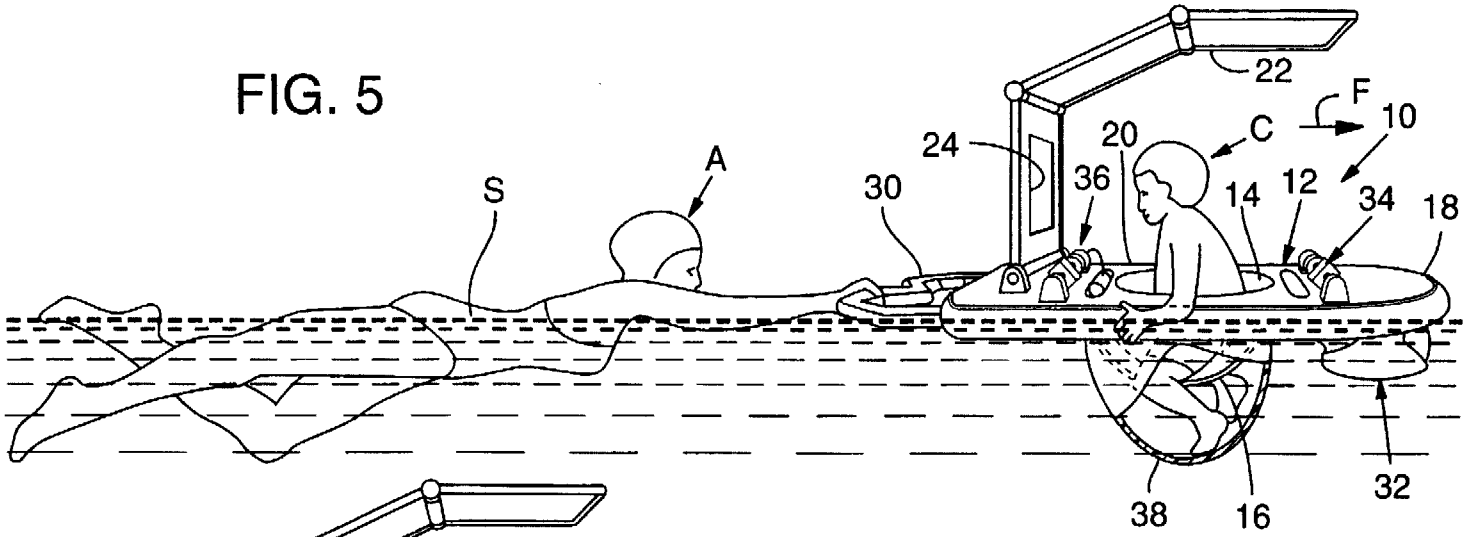
FIG. 5 is a perspective side view of the floatation device of FIG. 1 with a swimmer pushing the device and a child seated in the device.
Figure 6:
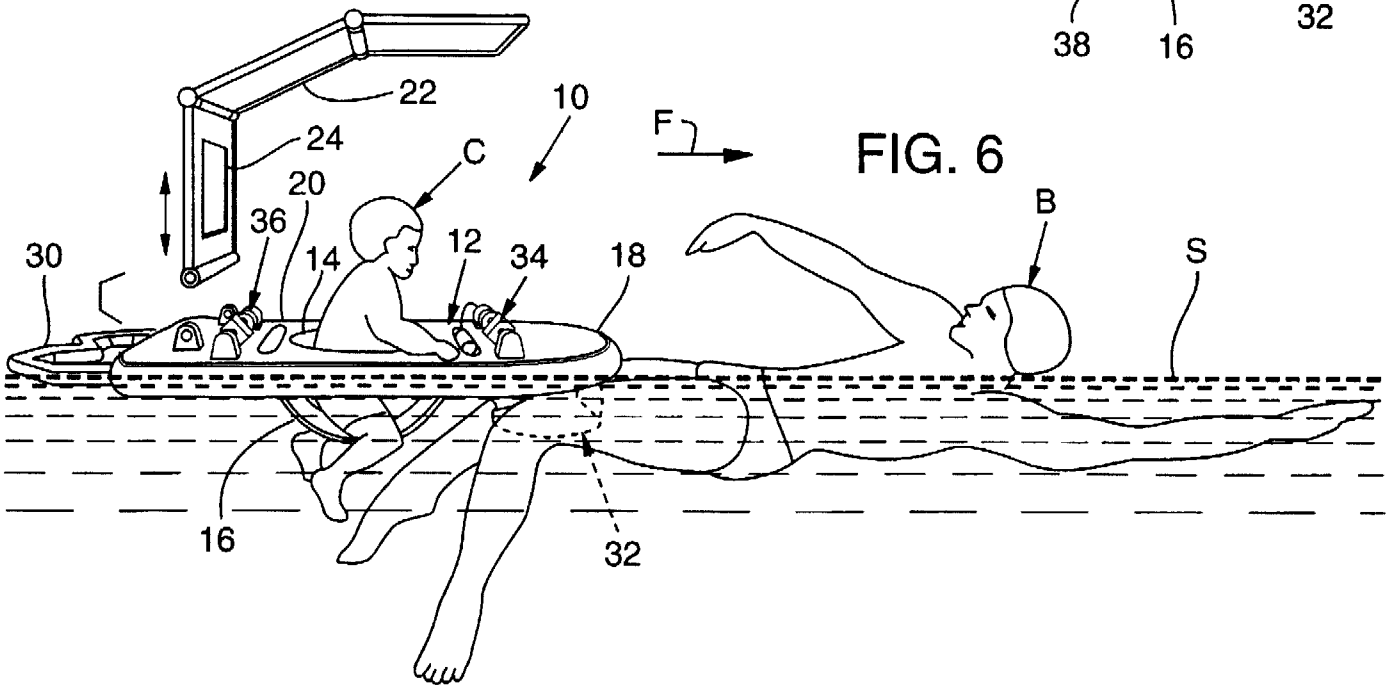
FIG. 6 is a perspective side view of the floatation device of FIG. 1 with a swimmer pulling it and a child seated in it.

As shown in FIGS. 1–6, the preferred embodiment of the flotation device of the present invention is generally indicated at 10. Directional terms used herein are relative to the forward direction of travel of the floatation device, as shown by arrow F in FIGS. 1, 3, 5 and 6. Front, frontal, forward, fore, bow, etc. are in the direction of arrow F. Rear, rearward, back, stern, aft, etc. are away from the direction of arrow F. A child (such as child C in FIGS. 5 and 6) is any small person who may need supervision when in the water. An adult (such as adult A in FIG. 5 and adult B in FIG. 6) is any person, regardless of actual age, capable of supervising a child. A series of horizontal dashed lines in FIGS. 5 and 6 represent water with bolded dashed line S indicating the surface of a body of water.

Figure 1:
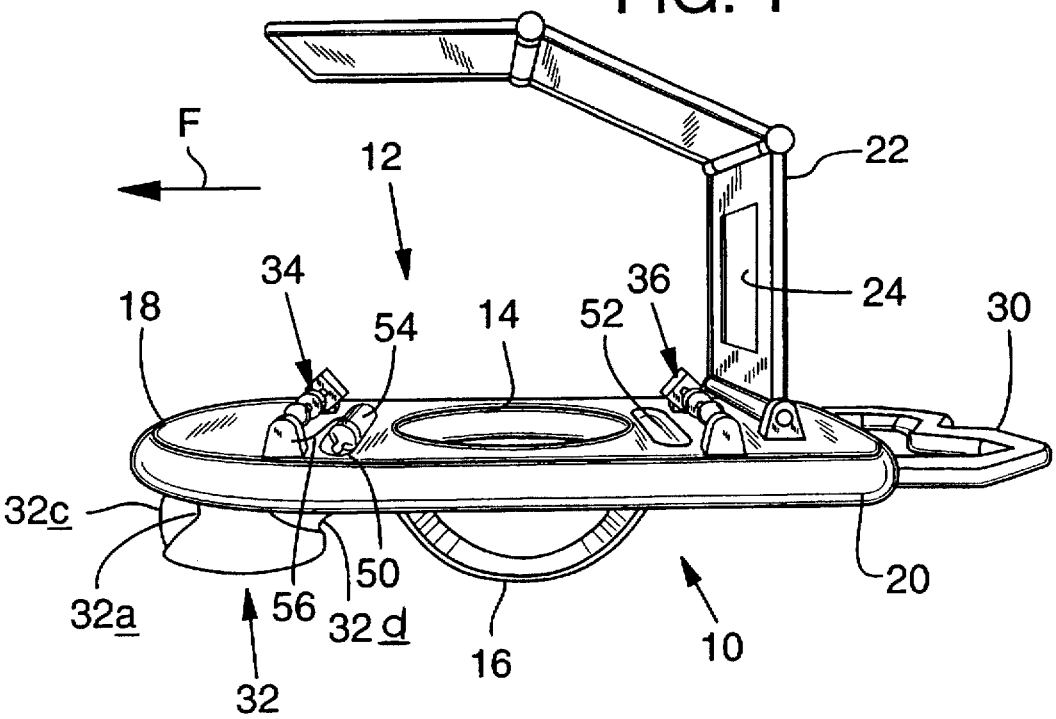
FIG. 1 is a perspective side view of an aquatic floatation device, constructed in accordance with a preferred embodiment.

As shown in FIG. 1, floatation device 10 includes a substantially planar buoyant board 12, dimensioned approximately two to three feet long and two feet wide. The board is generally rectangularly-shaped with rounded corners and a substantially rounded forward or bow region. The board has a substantially planar upper surface and a substantially planar lower surface. In the preferred embodiment, board 12 is constructed from sturdy closed-cell foam, but it may be constructed from any suitably buoyant and stiff material. The principal requirement is that the board be sufficiently buoyant to hold the weight of a child on top of the surface of the body of water.

FIG. 1 shows that approximately in the middle of board 12 is a generally circular opening 14 with a diameter of approximately eighteen inches. A holding seat 16 hangs directly below opening 14 and is connected to the underside of board 12 so that a child may be seated with legs straddling seat 16 facing forwardly or to the rear. Seat 16 is configured to keep a child's head above water surface S (see FIGS. 5 and 6) while the child is seated and to prevent the child from sliding off the seat into the water. FIG. 5 shows the child C facing rearwardly and FIG. 6 shows the child C facing forwardly.

As shown in FIGS. 1, 3, 5 and 6, board 12 may be generally divided into two regions: a fore region 18 (i.e., the bow) and an aft region 20 (i.e., the stern). A canopy 22 is attached to the aft region of board 12 and includes an upright portion and a cantilevered portion for extending over opening 14. The canopy, however, may be attached to any part of the board. The canopy effectively shields seated child C from the sun and from splashes. Preferably, the canopy is constructed from water resistant materials such as nylon fabric stretched between a rigid plastic frame. However, the canopy can be constructed from other suitable materials. Canopy 22 includes a window 24 through which an adult, such as adult A in FIG. 5, pushing the board from behind, may monitor the child. Window 24 may simply be an opening through the canopy or it may be a pane of transparent material, and as shown in FIG. 6, the canopy may be detached from board 12. The canopy is detachably mounted to the board by any suitable mechanism, such as water-resistant bolts threaded through the bottom of the canopy, a latching mechanism releasably holding the canopy, etc.

In order to facilitate bottle feeding of the child, board 12 preferably includes indented or recessed fore and aft bottle holders 50, 52 in which a bottle, such as bottle 54 shown in FIGS. 1, 3, 5 and 6, may be held when not in use. Although the recessed holders preferably are configured to hold a baby bottle or a pacifier, they may hold other items as desired. As best shown in FIG. 3, the bottle may be tethered to either of the toy racks via a leash 56 so that if a child drops the bottle, it will sink only a short distance so that it can be easily retrieved. The leash may tether other objects such as a pacifier or toys, as desired.

Floatation device 10 also includes a sturdy, foam-padded, wrap-around handlebar 30 attached to and extending from rear section 20 of board 12. As shown in FIG. 5, adult A grips handlebar 30 and uses the device like a conventional kickboard. FIG. 3 shows the wrap-around, grip-enhancing, curved design of the handlebar while being gripped by a pair of hands shown at H. As illustrated in FIG. 5, the floatation device provides a stable hydrodynamic object to keep the upper body of an adult afloat, thereby allowing the adult to isolate the lower body during swimming. While swimming and pushing the device, an adult is able to see and interact with a child through the canopy window.

Figure 2:
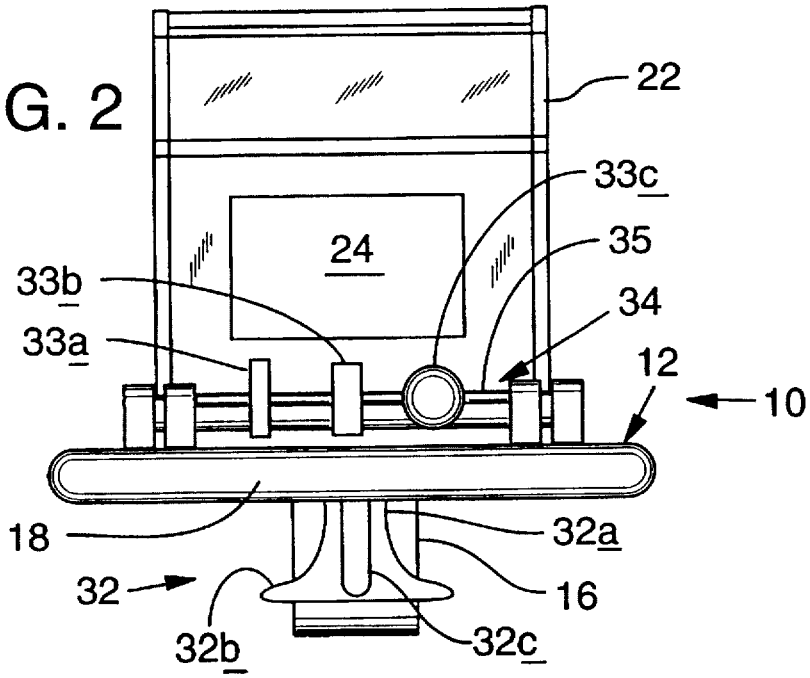
FIG. 2 is a front elevation view of the floatation device of FIG. 1.

Rather than pushing the floatation device by using the handlebar, an adult, such as adult B in FIG. 6, can swim while pulling the device by using a leg grip 32 which is attached to the underside of fore region 18 of board 12. As shown in FIGS. 1, 2 and 4, the leg grip has a somewhat cylindrical base **32*a* that depends downwardly away from the board and radially tapers outwardly from the base to form an outer ridge 32*b*. The leg grip also includes forward and rearward fins 32*c*, 32*d*** which extend vertically between the ridge and the underside of the board.

As shown in FIGS. 4 and 6, the curved sides formed on each side of leg grip 32 are dimensioned to receive the adult's legs L so that the leg grip may be clinched and held between by the legs. When the adult presses the legs toward each other and against leg grip 32, the combination of board 12 and outer ridge **32*b*** maintains the legs in position, and prevents them from slipping loose while the adult swims.

As shown in FIGS. 4 and 6, an adult B may use the floatation device by clinching the feet or knees against the sides of the grip and leaning back to swim by using the backstroke, sidestroke or other similar strokes. The device provides a more stable hydrodynamic object to keep the adult's lower body afloat, thereby allowing isolation of the upper body for swimming exercise. Assuming the child is facing forward, the adult may interact with the child and the child may see the adult.

Although use of leg grip 32 has been described in the context of an adult performing a backstroke, the leg grip may be used by an adult facing forwardly or sideways and performing other strokes. For example, an adult may grip onto the leg grip by the feet, and swim using the crawl stroke. Also, like the board, the leg grip is preferably constructed from closed-cell foam.

As shown in FIGS. 1–6, the floatation device also includes fore and aft toy racks 34 and 36 which are attached to the fore and aft regions, respectively. Each toy rack includes a bar, such as bar 35 in FIG. 2, and slidably-attached to each bar are a plurality of preferably colorful and appealing objects (such as toys **33*a*, 33*b* and 33*c* in FIG. 2). Fore toy rack 34 is positioned so that a forward-seated child can reach and play with the toys on the rack. Likewise, aft toy rack 36** is positioned so that a rearward-seated child can reach and play with the toys on that rack. Instead of or in addition to the toy racks, other embodiments could include a play steering wheel, action figures, water toys, sound-making toys, etc.

As shown in FIG. 5, an alternative embodiment of the floatation device may include a water-tight bubble or undercarriage 38 (shown partially broken away) attached to the underside of the board 12. The undercarriage is arcuately connected around opening 14 so that child C seated on holding seat 16 is separated from the water by the undercarriage while the board floats on surface S of the body of water, thereby keeping the child dry and warm. Moreover, when the temperature of the body of water is low, the undercarriage may be filled with warm water to keep the child warm.

While the present invention has been shown and described with reference to the foregoing operational principles and preferred embodiment, it will be apparent to those skilled in the art that various changes in form and detail may be made without departing from the spirit and scope of the invention as defined by the appended claims.

We claim:

1. A floatation device for use on a surface of a body of water comprising:

a buoyant, substantially planar board having fore and aft regions, the board including an opening therethrough located between the fore and aft regions and a holding seat attached to the board configured to support a child seated thereon so that the child's head is positioned above the surface of the body of water;

a handlebar connected to the aft region of the board configured for grasping by an adult while swimming, thereby pushing the board across the surface of the body of water; and a leg grip extending from the fore region into the water and configured for an adult to clinch with the legs while swimming to thereby pull the board across the surface of the body of water.

2. The floatation device of claim 1, wherein the board has a substantially continuous upper surface and has substantially continuous lower surface.

3. The floatation device of claim 1 further comprising a canopy over the board which is attached to the board and configured to shield the child from sunlight and from water splashes, the canopy including a transparent canopy window through which an adult on a first side of the canopy may view and visually interact with a child who is seated on the holding seat located on a second side of the canopy which second side is opposite of the first side of the canopy.

4. The floatation device of claim 3, wherein the canopy is selectively attachable to and detachable from the board.

5. The floatation device of claim 1, wherein the holding seat is configured so that a child may be selectively seated facing the fore region or facing the aft region.

6. The floatation device of claim 5 further comprising fore and aft toy racks attached to the board within reach of a child seated in the holding seat, the fore toy rack located in the fore region adjacent the hole so that a child facing the fore region can play with toys of the fore toy rack and the aft toy rack located in the aft region adjacent the hole so that a child facing the aft region can play with toys of the aft toy rack.

7. The floatation device of claim 1 further comprising a water-tight undercarriage arcuately connected around the hole and configured to separate a child seated in the holding seat from the body of water while the board floats on the surface of the body of water, thereby keeping the child dry and warm.

8. The floatation device of claim 1 further comprising an object-tethering leash having a first end operatively attached to the board and a second end tethering an object so that if the object fell into the body of water, the object may be easily retrieved.

9. A floatation device comprising:

a buoyant, substantially planar board having fore and aft regions, the board including an opening therethrough located between the fore and aft regions and a holding seat attached to the board configured to support a child seated thereon so that the child's head remains above the surface of the body of water, the board configured to allow an adult to grip the board adjacent the aft regions while swimming behind the board and pushing the board;

a canopy attached to the board and configured to shield the child from sunlight and from water splashes, the canopy including a transparent canopy window through which the adult on a first side of the canopy may view and visually interact with a child who is seated on the holding seat located on a second side of the canopy which is opposite of the first side of the canopy;

a holding seat configured so that a child may be seated facing the fore region or alternatively seated facing the aft region and further wherein the holding seat is configured prevent the child from sliding off the seat into the water; and fore and aft toy racks attached to the board within reach of a child seated in the holding seat, each toy rack including toys to entertain and/or educate the child, the fore toy rack located in the fore region adjacent the fore so that a child facing the fore region can play with toys of the fore toy rack and the aft toy rack located in the aft region adjacent the hole so that a child facing the aft regions can play with toys of the aft toy rack.

10. The floatation device of claim 9, further comprising:

a handlebar connected to the aft region of the board configured for grasping by an adult while swimming, thereby pushing the board across the surface of the body of water, and a leg grip extending from the fore region into the water and configured for an adult to clinch with legs while swimming, thereby pulling the board across the surface of the body of water.

11. A child-float/adult-aquatic-exerciser floatation device for use on a surface of a body of water, the floatation device comprising:

a buoyant, substantially planar board having fore and aft regions, the board including an opening therethrough located between the fore and aft regions and a holding seat attached to the board configured to support a child seated thereon so that the child's head remains above the surface of the body of water;

a handlebar connected to the aft region of the board configured for grasping by an adult while swimming, thereby pushing the board across the surface of the body of water;

a leg grip extending configured for an adult to clinch with the legs while swimming to thereby pull the board across the surface of the body of water; and a canopy attached to the board and configured to shield the child from sunlight and from water splashes, the canopy including a window through which an adult on a first side of the canopy may view and visually interact with a child who is seated on the holding seat located on a second side of the canopy which is opposite of the first side of the canopy.

12. The floatation device of claim 11, wherein the holding seat is configured so that a child may be seated facing the fore region or alternatively seated facing the aft region.

13. The floatation device of claim 12 further comprising fore and aft toy racks attached to the board within reach of a child seated in the holding seat, each toy rack including toys to entertain and/or educate the child, the fore toy rack located in the fore region adjacent the hole so that a child facing the fore region can play with toys of the fore toy rack and the aft toy rack located in the aft region adjacent the hole so that a child facing the aft region can play with toys of the aft toy rack.

14. A child-float/adult-aquatic-exerciser floatation device for use on a surface of a body of water, the floatation device comprising:

a buoyant, substantially planar board having fore and aft regions, the board including an opening therethrough located between the fore and aft regions and a holding seat hanging below the opening and attached to the board, the seat configured to support a child seated thereon so that the child's head remains above the surface of the body of water;

a handlebar connected to the board configured for grasping by an adult while swimming, thereby pushing the board across the surface of the body of water;

a leg grip connected to the board and configured for an adult to clinch with the legs while swimming to thereby pull the board across the surface of the body of water.

15. The floatation device of claim 14 further comprising a canopy attached to the board and configured to shield the child from sunlight and from water splashes, the canopy including a window through which an adult on a first side of the canopy may view and visually interact with a child who is seated on the holding seat located on a second side of the canopy which is opposite of the first side of the canopy.

16. A child-float/adult-aquatic-exerciser floatation device for use on a surface of a body of water, the floatation device comprising: a buoyant, substantially planar board configured to support a child seated thereon so that the child's head remains above the surface of the body of water; and a leg grip connected to the board and configured for an adult to clinch with the legs while swimming to thereby pull the board across the surface of the body of water.

* * * * *